US010655930B2

(12) United States Patent
Gordon et al.

(10) Patent No.: US 10,655,930 B2
(45) **Date of Patent: *May 19, 2020**

(54) INSIDE WAISTBAND CONCEALED CARRIER

(71) Applicant: Turning Point Distribution, LLC, Sanford, FL (US)

(72) Inventors: Cecil Wayne Gordon, Hastings, FL (US); David A. Foster, Sanford, FL (US)

(73) Assignee: Turning Point Distribution, LLC, Sanford, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/237,474

(22) Filed: Dec. 31, 2018

(65) Prior Publication Data

US 2019/0137216 A1 May 9, 2019

Related U.S. Application Data

(63) Continuation of application No. 15/469,172, filed on Mar. 24, 2017, now Pat. No. 10,168,121, which is a (Continued)

(51) Int. Cl.

| | |
|---|---|
| ***F41C 33/02*** | (2006.01) |
| ***A45F 5/02*** | (2006.01) |
| ***F41C 33/04*** | (2006.01) |

(52) U.S. Cl.

CPC ..... *F41C 33/0218* (2013.01); *A45F 5/021* (2013.01); *F41C 33/041* (2013.01); *F41C 33/048* (2013.01)

(58) Field of Classification Search

CPC ..... F41C 33/04; F41C 33/041; F41C 33/043; F41C 33/045; F41C 33/046; F41C 33/048; F41C 33/02; F41C 33/0209; F41C 33/0218; F41C 33/0227; F41C 33/0254; F41C 33/0263; F41C 33/0272; F41C 33/0281; F41C 33/029; F41C 33/00; F41C 33/006–008; F41C 33/0236; (Continued)

(56) References Cited

U.S. PATENT DOCUMENTS 3,126,136 A * 3/1964 Kippen ..... F41C 33/0227 224/243

3,379,349 A 4/1968 Hier (Continued)

*Primary Examiner* — Scott T McNurlen

(74) *Attorney, Agent, or Firm* — Weide & Miller, Ltd.

(57) ABSTRACT

An inside waistband holster includes a front panel comprising a waistband connector that holds a top side of the front panel at a waistline of a user's pants. The holster also includes a back panel attached to the front panel, such as along a bottom side of the back panel and the front panel and along lower sides of the back panel and the front panel. The front panel and the back panel define a pouch in which a firearm may in stored, and a top portion of the front panel is unattached to the back panel. The back panel includes a flap configured to extend over the front panel and to releasably connect to the waistband connector in a stored condition. The flap is also configured to be pulled upward such that the top portion of the front panel peels away from the back panel in an exposed position.

20 Claims, 6 Drawing Sheets

Related U.S. Application Data continuation-in-part of application No. 15/334,035, filed on Oct. 25, 2016, now Pat. No. 10,101,120, which is a continuation of application No. 14/696,252, filed on Apr. 24, 2015, now Pat. No. 9,500,440.

(60) Provisional application No. 61/944,912, filed on Feb. 26, 2014.

(58) Field of Classification Search
CPC ..... F41C 33/0245; A45F 5/021; A45F 5/02; A45F 2200/0591; Y10S 224/911

USPC ..... 224/192–193, 198, 238, 243–244, 911, 224/587, 674

See application file for complete search history.

(56) References Cited

U.S. PATENT DOCUMENTS

| | | | |
|---|---|---|---|
| 4,165,826 | A | 8/1979 | Chica |
| 4,312,466 | A | 1/1982 | Clark |
| 4,696,419 | A | 9/1987 | Holtzclaw, Jr. et al. |
| 4,858,800 | A | 8/1989 | Holtzclaw, Jr. et al. |
| 5,201,447 | A | 4/1993 | Bumb et al. |
| 6,561,402 | B2 | 5/2003 | Holland et al. |
| 2003/0094470 | A1 | 5/2003 | Cragg |
| 2006/0219743 | A1 | 10/2006 | Gallagher |
| 2009/0117956 | A1 | 5/2009 | Latz |
| 2010/0270349 | A1 | 10/2010 | Craighead |
| 2012/0196695 | A1 | 8/2012 | Johnson |
| 2013/0015225 | A1 | 1/2013 | Hogue |
| 2013/0306693 | A1 | 11/2013 | Prestwich |
| 2015/0184978 | A1 | 7/2015 | Hedeen |
| 2015/0237998 | A1 | 8/2015 | Stevens, IV |
| 2016/0061564 | A1 | 3/2016 | Gordon et al. |
| 2017/0199007 | A1 | 7/2017 | Gordon et al. |

* cited by examiner

INSIDE WAISTBAND CONCEALED CARRIER

CROSS REFERENCE TO RELATED APPLICATIONS

This application is a continuation of U.S. patent application Ser. No. 15/469,172, filed Mar. 24, 2017, which is a continuation in part of U.S. patent application Ser. No. 15/334,035, filed Oct. 25, 2016, now U.S. Pat. No. 10,101,120, which is a continuation of U.S. patent application Ser. No. 14/696,252, filed Apr. 24, 2015, now U.S. Pat. No. 9,500,440, which claims priority to U.S. Provisional Application No. 61/944,912, filed Feb. 26, 2014, the contents of which are hereby incorporated by reference.

BACKGROUND

The disclosed embodiments relate to wearable pouches, bags, packs, or holsters. Some embodiments may relate to holsters for carrying firearms, including holsters that can be worn inside the waistband (of a wearer's pants) to carry a concealed weapon. Other embodiments relate to carriers for other personal items, including carriers that can be worn inside the waistband.

Individuals with a concealed weapons license (CWL) must generally follow a number of guidelines in order to maintain their carrying permit. One of the guidelines describes the manner in which the weapon, typically a handgun, is carried on the person. The handgun must be completely covered at all times and cannot "paint" an impressed image of the handgun through any of the person's clothing.

Many holsters are worn on the outside of the belt. To be within the guidelines of a CWL, a person must wear a very large and loose shirt or jacket to cover the handgun. Another option is to use an IWB (inside waistband) style holster. This style of holster typically tucks the handgun inside the pants or pocket. However, in most instances the firearm's handle still protrudes from the top of the holster and needs to be covered with additional clothing to avoid exposure.

In order to be within concealed weapons guidelines the handgun cannot be visible in any way. However, as described above, typical belt-worn holsters have a part of the handgun or the handgun in its entirety exposed. This results in the need for additional and typically loose clothing to be worn by the user in order to be within the licensed guidelines.

SUMMARY

The disclosed embodiments have been developed in light of the above-described problems. The disclosed embodiments described herein could be termed as an "internal pocket" that completely conceals a firearm (or other persona items) in its entirety. The embodiments also prevent the "painting" of the firearm's shape through the user's clothing while simultaneously providing easy access to the firearm for the user. In addition, the inside of the flap or other areas of the holster may include prefabricated slots for the user's carry permit, identification card(s), and/or other paperwork.

The disclosed embodiments differ from what currently exists. The design of the concealed weapons handgun holster as described in the embodiments below completely conceals a firearm without the need for additional bulky clothing to cover the firearm, while also providing immediate access and storage. This design conceals the firearm in its entirety without the handle or any parts of the firearm being exposed. This prevents any unintentional exposure to others while also preventing theft or loss.

The disclosed embodiments may not only conceal a firearm, but the "internal pocket" may also be used for other important objects that are secured on a person. Such objects may include cash, wallets, identification, travel documents, and the like.

According to some embodiments, an inside waistband holster includes a front panel comprising a waistband connector that holds a top side of the front panel at a waistline of a user's pants. The holster also includes a back panel attached to the front panel along a bottom side of the back panel and the front panel and along lower sides of the back panel and the front panel. The front panel and the back panel define a pouch in which a firearm may in stored, and a top portion of the front panel is unattached to the back panel. The back panel includes a flap configured to extend over the front panel and to releasably connect to the waistband connector in a stored condition. The flap is also configured to be pulled upward such that the top portion of the front panel peels away from the back panel in an exposed position, raising and exposing any firearm located in the holster.

Further objects, features, and advantages of the present invention over the prior art will become apparent from the detailed description of the drawings which follows, when considered with the attached figures.

DETAILED DESCRIPTION OF EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Figure 1:
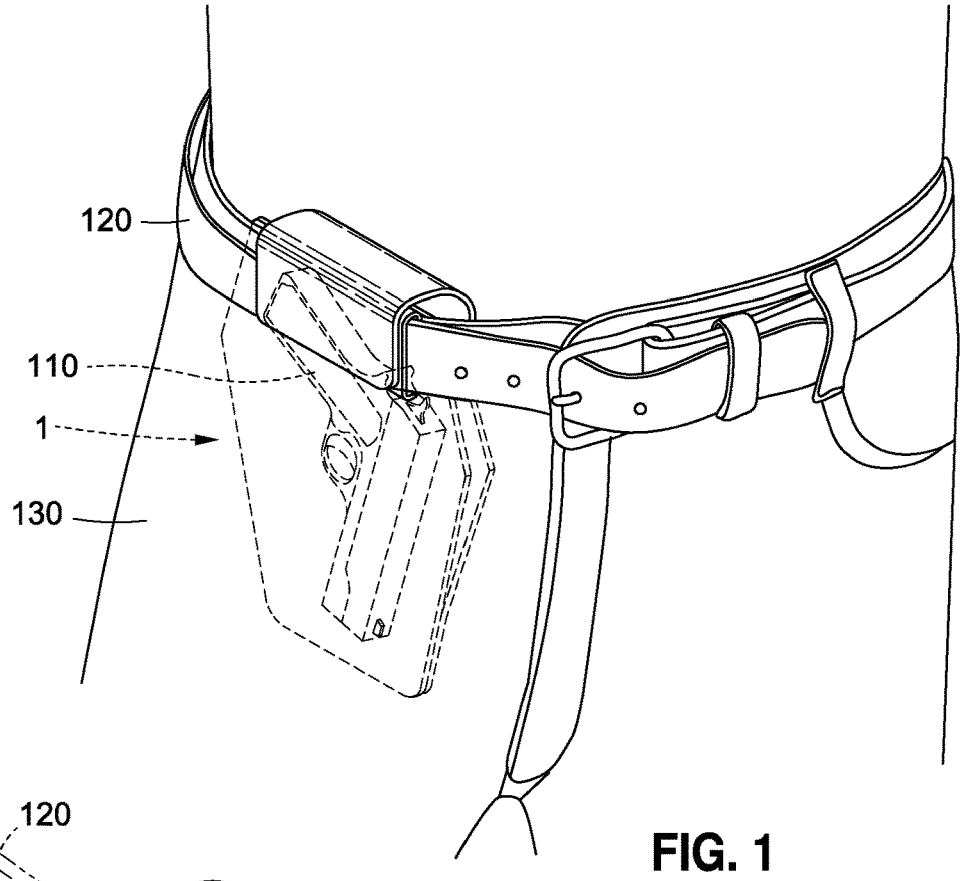
FIG. 1 illustrates an inside waistband holster for a concealed weapon as worn by a user according to one exemplary embodiment.

FIG. 1 illustrates an inside waistband holster for a concealed weapon as worn by a user according to one exemplary embodiment. As shown in FIG. 1, a holster 1 is configured to be worn inside the waistband of a user's pants (or other clothing, such as shorts, a skirt, etc., wherein such clothing has a top or top edge that generally circles the user's waist and extends downwardly to cover at least a portion of the user). In this embodiment, the holster 1 attaches to a user's belt 120 and is worn on the inside of the user's pants 130. The holster 1 is comprised of pliable material, such as leather, faux leather, cloth, nylon, or other flexible fabrics.

Figure 2A:
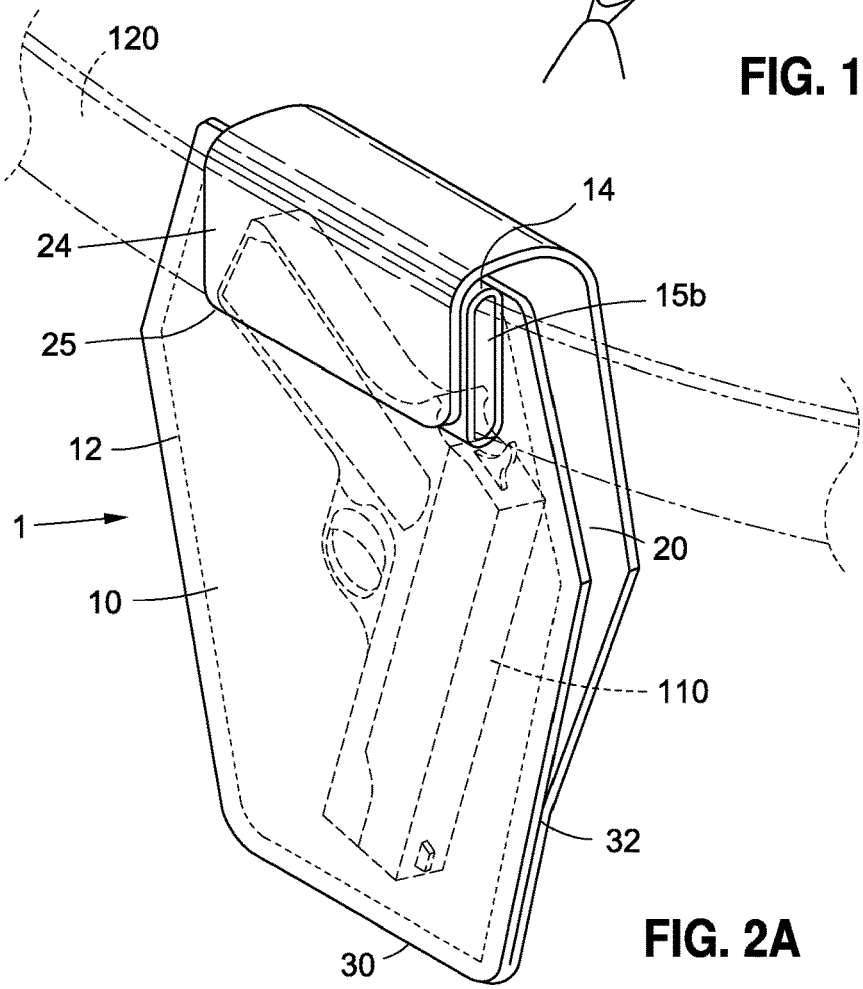
FIG. 2A illustrates an inside waistband holster for a concealed weapon.
Figure 2B:
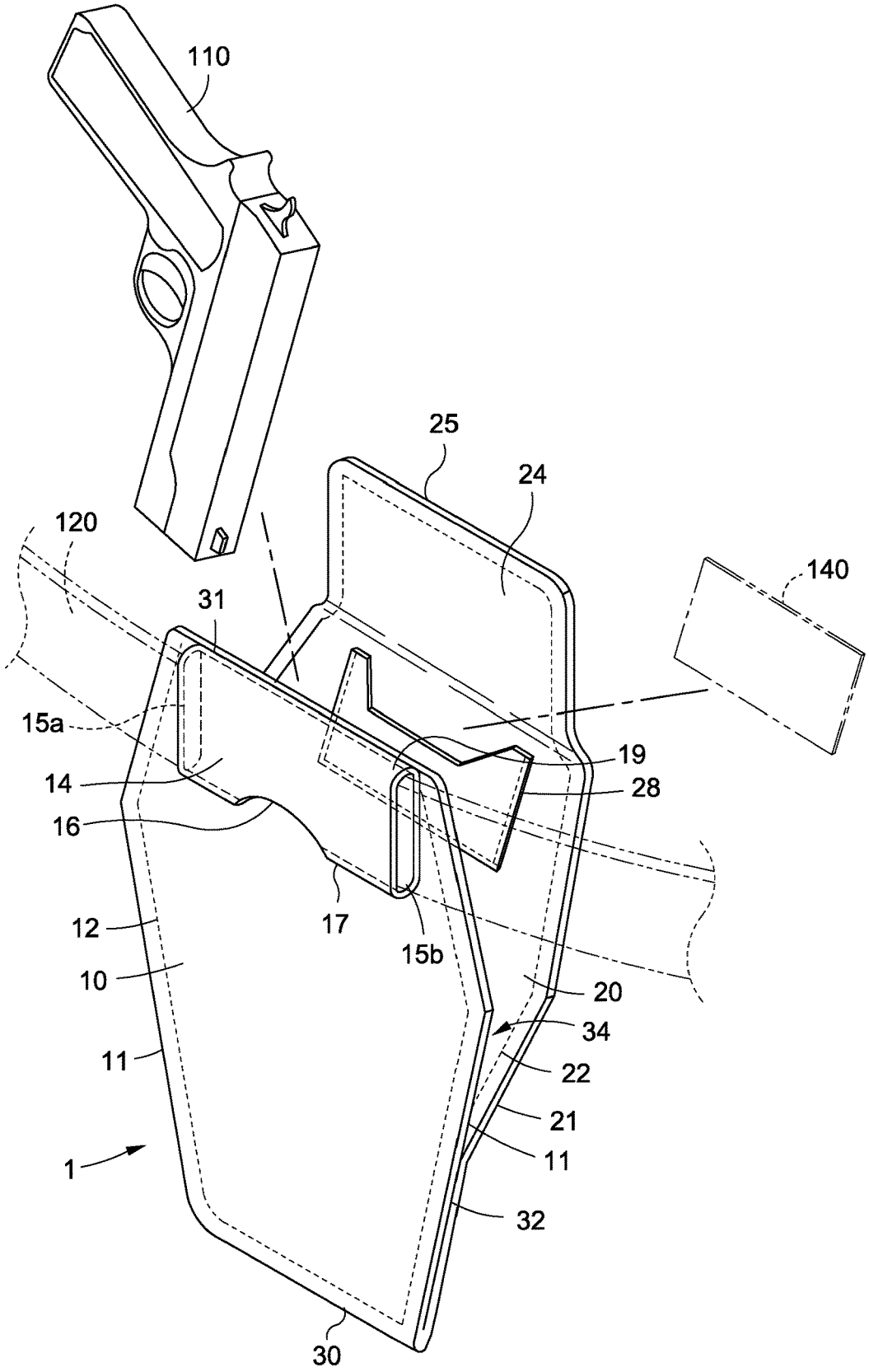
FIG. 2B is a view of the holster of FIG. 2A with the flap open, according to one exemplary embodiment.

FIG. 2A shows the inside waistband holster for a concealed weapon in a closed position, and FIG. 2B is a view of the holster of FIG. 2A with the flap open, according to one exemplary embodiment. The holster 1 includes a front panel 10 and a back panel 20. The front panel 10 and the back panel 20 are preferably joined together along the bottom side 30 of the holster 1. The front panel 10 may be joined to the back panel 20 along the bottom side 30 by any known manner such as by stitching, adhesives, fasteners, or the like. In one embodiment, the front panel 10 and the back panel 20 are formed or cut from a single piece of material and are folded together at the bottom side 30 of the holster. The front panel 10 and the back panel 20 may include stitching 12, 22 along the borders of the panels 10, 20 for decorative effect, and to prevent fraying of the material. The stitching 12, 22 may also serve to hold layers of fabric together which may collectively form the front panel 10 and the back panel 20 in some embodiments.

The front panel 10 preferably includes a mean for mounting the holster 1 to a wearers pants, such as an associated belt. In one embodiment, the means for mounting comprises a belt loop 14 that is configured to receive a belt 120 therethrough. The belt loop 14 is connected to the front panel 10 at the top 31 of the front panel 10. Specifically, a top portion 19 of the belt loop 14 is attached to the top 31 of the front panel such that the belt loop 14 may be on the outside of the pants 130 while the remainder of the font panel 10 is inside the pants.

The belt loop 14 may be attached to the front panel in any suitable manner including stitching, adhesives, fasteners, or the like. The belt loop 14 may also be formed integrally with the front panel and is folded over at the top 31 of the holster. The belt loop 14 forms a first hole 15*a* and a second hole 15*b* through which the belt 120 may pass. To aid the user in threading the belt 120 through the belt loop 14, a cutout 16 may be provided in a lower side 17 of the belt loop 14. The cutout 16 may also accommodate a belt loop associated with the pants, whereby the user may thread their belt through the first portion of the belt loop 14, then the pants belt loop, then the second portion of the belt loop 14, thus securing the belt to their pants and securing the holster 1 to the belt 120.

The back panel 20 includes a top flap 24. The top flap 24 is configured to releasably connect to the front panel 10, such as the belt loop 14. In one embodiment, the top flap 24 is configured to extend around or over the top 31 of the front panel 10 so that the tip 25 of the flap 24 releasably attaches to the belt loop 14, such as a front thereof or at the bottom side 17 of the belt loop 14. The flap 24 allow the user to selectively gain access to the firearm 110 in the holster 1, as will be described in more detail below.

The front panel 10 and the back panel 20 cooperate to form a pouch 34. In one embodiment, the pouch 34 is defined by the front panel 10, the back panel 20, the bottom side 30 of the holster 1, and a connection 32 between the sides 11, 21 of the front panel 10 and the back panel 20. The connection 32 may be stitching, adhesive, fasteners, connecting fabric or other material or the like that extends partially up the sides 11, 21 of the front and back panels 10, 20. The height of connection 32 may extend further or less than that shown in the figures so long as the holster 1 may be configured to operate as described in more detail below.

The pouch 34 is configured to hold the firearm 110 within the holster 1. When the holster 1 is closed, as described below and illustrated in FIG. 1, the firearm 110 is located inside the pouch 34—.e.g is not visible from the outside of the holster 1. Thus, the pouch 34, and also the front and back panels 10, 20, are sized to accommodate a firearm. The size of the pouch 34, and thus the configuration of the front and back panels 10, 20, may vary depending upon the particular firearm 110 which is to be housed in the holster 1 (for example, the size and shape of the front and back panels 10, 20 may vary to change the size and shape of the pouch 34, such as to accommodate firearms of different sizes and/or shapes). For example, in one embodiment, the front and back panels 10,20 are sized so that the pouch 34 has a first width at the bottom 30, the pouch has an increased second width between the top and bottom, and a third width at the top (where the third width is less than the second width).

The pouch 34 may further be configured to hold other items next to the firearm 110, or in place of the firearm 110 when the firearm 110 is not being carried. For example, the pouch 34 may hold the user's cell phone, ammunition for the fire arm, keys, wallet, and the like.

In this embodiment, the back panel further includes a slot 28 for holding a card 140, such as a concealed weapons permit, identification, credit card, or the like. In FIG. 2B, the slot 28 is associated with or defined at the inside of the back panel 20. However, the slot 28 may be placed at any suitable location on the holster 1. For example, there may be a slot 28 on the front of the belt loop 14, on the inside of the top flap 24, or on the rear surface of the back panel 20. More than one slot 28 may be implemented on the holster 1.

Figure 3A:
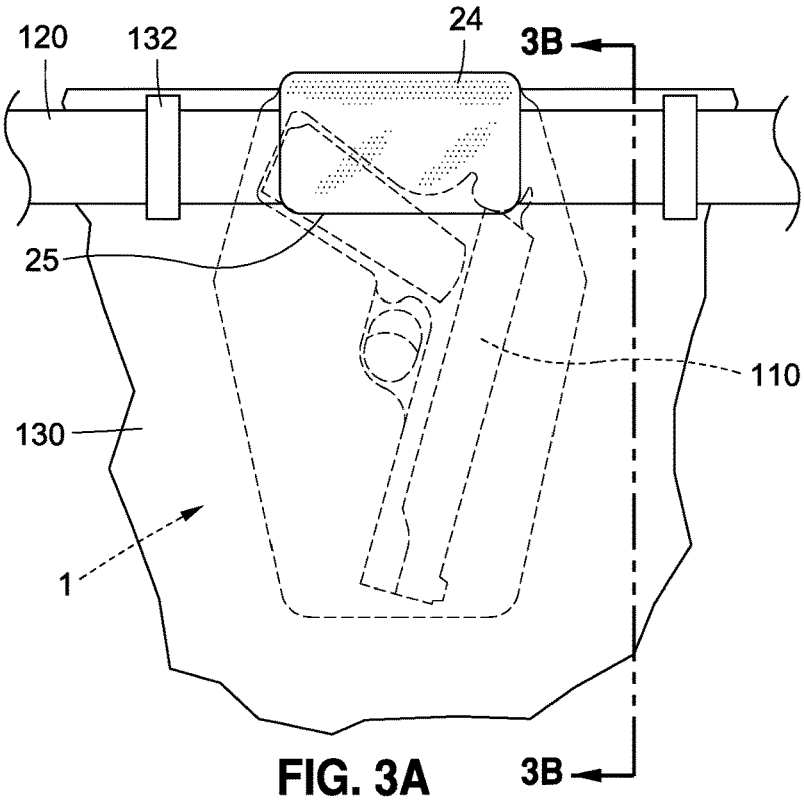
FIG. 3A is a front view of an inside waistband holster for a concealed weapon in a first position, according to one exemplary embodiment.
Figure 3B:
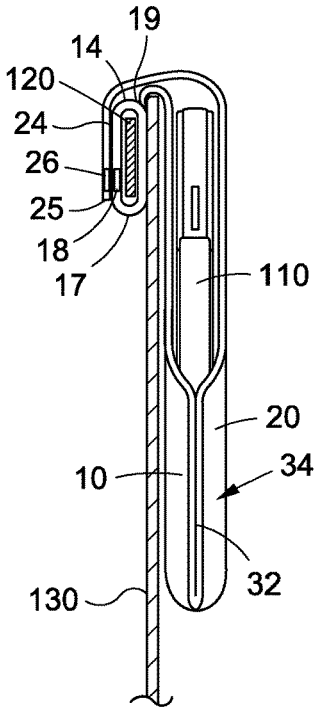
FIG. 3B is a side view of the holster shown in FIG. 3A.

The operation of the holster 1 will now be described with reference to FIGS. 3A-5C. FIGS. 3A and 3B show the holster 1 with the firearm 110 in a stored position. Specifically, the holster 1 is threaded onto the belt 120 by way of the belt loop 14. The top of the waistband of the pants fits between the belt loop 14 and the front panel 10. The top flap 24 is in the closed position such that the top 25 of the flap 24 is attached to the bottom side 17 of the belt loop 14. In this position the holster 1 is located inside of the wearer's pants below the waistline thereof, whereby the firearm 110 located in the holster 1 is completely enclosed, hidden within the holster 1, also being positioned inside of the wearer's pants, below the waistline.

In this embodiment, the top 35 of the flap 24 includes an embedded magnet or magnetically attracted material 26. The bottom side 17 of the belt loop 14 similarly includes a corresponding embedded magnet or magnetically attracted material 18. In this manner, when the holster 1 is in the closed position, the top 25 of the flap 24 and the bottom 17 of the belt loop 14 are held together by the magnetic force between the magnets 18, 26. Other connectors or means for connecting the flap 24 and the belt loop 14 may also be used including hook and loop fasteners (known as Velcro®), a buckle, snaps, clips, buttons, or any other suitable releasable connector.

Figure 4A:
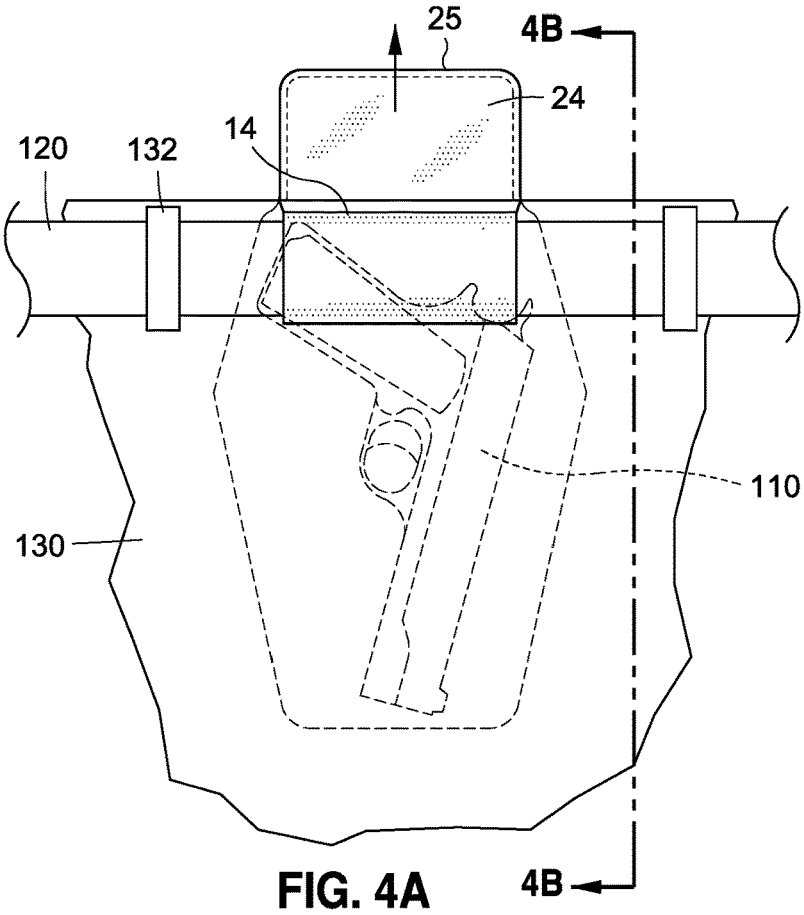
FIG. 4A is a front view of an inside waistband holster for a concealed weapon in a second position, according to one exemplary embodiment.
Figure 4B:
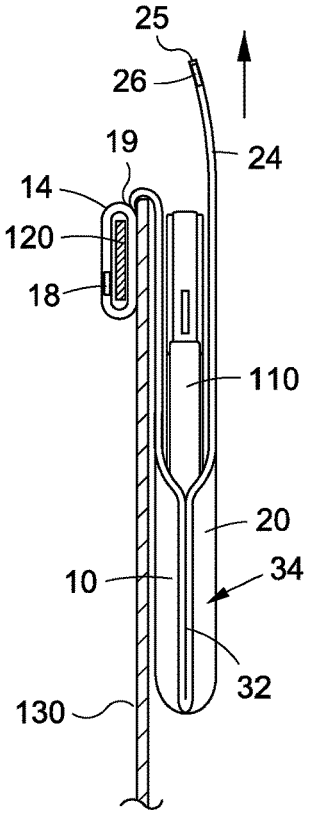
FIG. 4B is a side view of the holster shown in FIG. 4A.
Figure 5A:
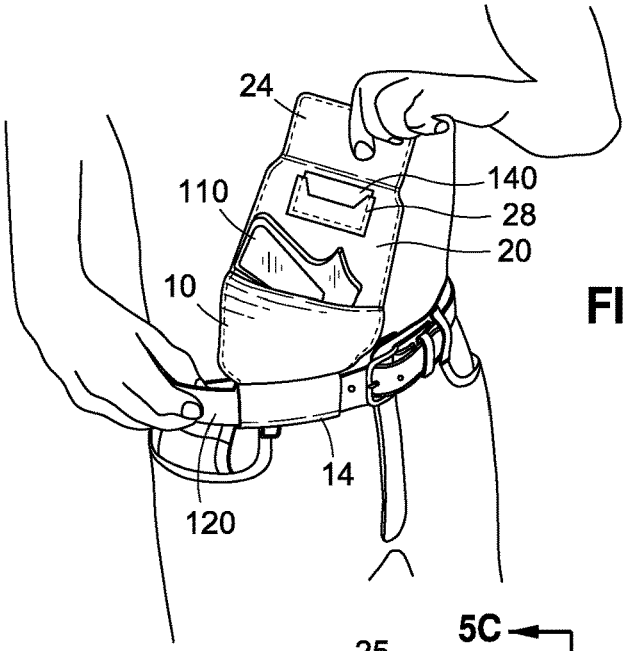
FIG. 5A is a perspective view of an inside waistband holster for a concealed weapon in a third position as worn by a user, according to one exemplary embodiment.
Figure 5B:
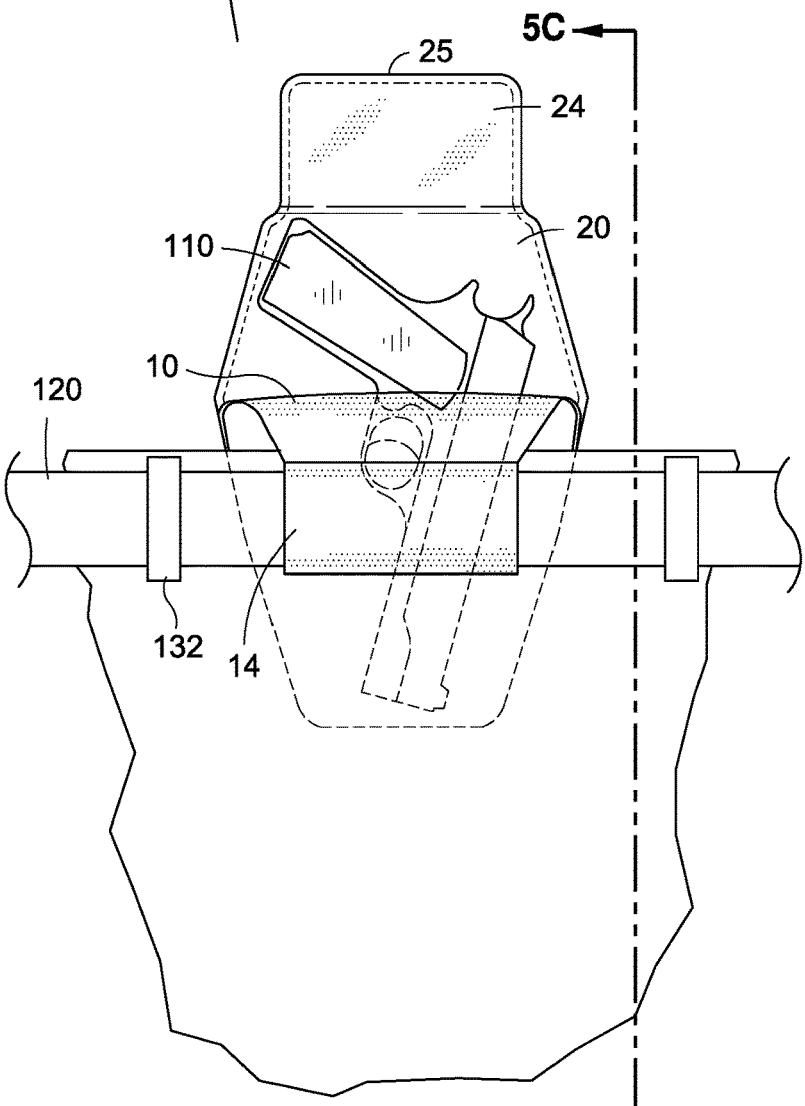
FIG. 5B is a front view of the holster shown in FIG. 5A.
Figure 5C:
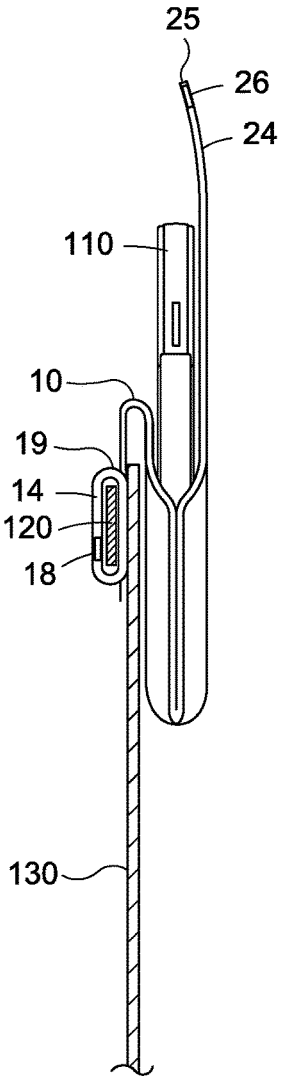
FIG. 5C is a side view of the holster shown in FIG. 5A.

To access the firearm 110 within the holster 1, the flap 24 is first moved to the position shown in FIGS. 4A and 4B. That is, the user disconnects the top 25 of the flap 24 from the bottom 17 of the belt loop 14 and pulls the flap 24 upwards. It is noted that even when the holster 1 is in the position shown in FIGS. 4A and 4B with the flap 24 pulled up, the firearm 110 remains concealed below the waistline of the user's pants 130.

To expose and remove the firearm 110, the user continues to pull upwardly on the flap 24. This motion causes the front panel 20 to roll upwardly, raising the bottom 30 of the pouch 34 of the holster 1. The user may thus in this manner raise the holster 1 into the position shown in FIGS. 5A-5C. As can be seen, the front panel 10 remains connected to the belt loop 14 and is rolled open as the holster 1 is raised. Stated differently, the front panel 10 peels away from the back panel 20 as the holster 1 is raised due to the connection between the front panel 10 and the belt loop 14 that is threaded onto the user's belt 120. As noted above, when the holster 1 is in its stored position, the top of the front panel 10 and the top of the back panel 20 are at approximately the same height at the top of the user's pants/belt. However, in the exposed position, the top of the front panel 10 is above the user's pants/belt and the top of the back panel 20 is much higher than the top of the front panel 20, whereby the grip or other top portion of the firearm is also raised above the top of the user's pants into an exposed position (e.g.—in accordance with one embodiment of the invention, opening or exposing of the holster 1 by raising upwardly on the back panel 20 causes the position of the firearm or other contents of the holster 1 to change from a stored position inside of the wearer's pants and below the waistline, to an exposed position out of the wearer's pants and above the waistline).

With the front panel 10 and rear panel 20 in this position, the firearm 110 is exposed, and the user can easily gain access to the firearm 110. Furthermore, because the front panel 10 is attached to the belt loop 14, the firearm 110 remains securely in the pouch 34 and does not fall out. That is, the connection 32 between the front and the back panels 10, 20 forming the pouch 34 limits the distance that the holster 1 can be raised by limiting the portion of the front panel 10 that is peeled away from the back panel 20 (and keeps the muzzle of the firearm within the pouch 34). At the same time, in this position the top of the firearm 110, such as the grip, is accessible to the wearer to remove the firearm 110.

To return the firearm 110 into the stored, concealed position in the holster 1, the above described process is reversed so that the holster 1 is again in the position shown in FIGS. 3A and 3B. That is the firearm 110 is placed within the pouch 34, and the user pushes the holster 1 down so that the front panel 10 and the back panel 20 are again brought together and are concealed within and below the waistline of the user's pants 130.

The above described holster 1 in suitable for both left and right handed users and may be worn on the left side, the right side, or on the backside of the pants 130. The holster 1 may also be modified in size to fit a wide variety of firearms. That is, the size of the panels 10, 20 and pouch 34 may be configured to fit any number of types of firearms 110 that may be carried with a CWL.

Figure 6A:
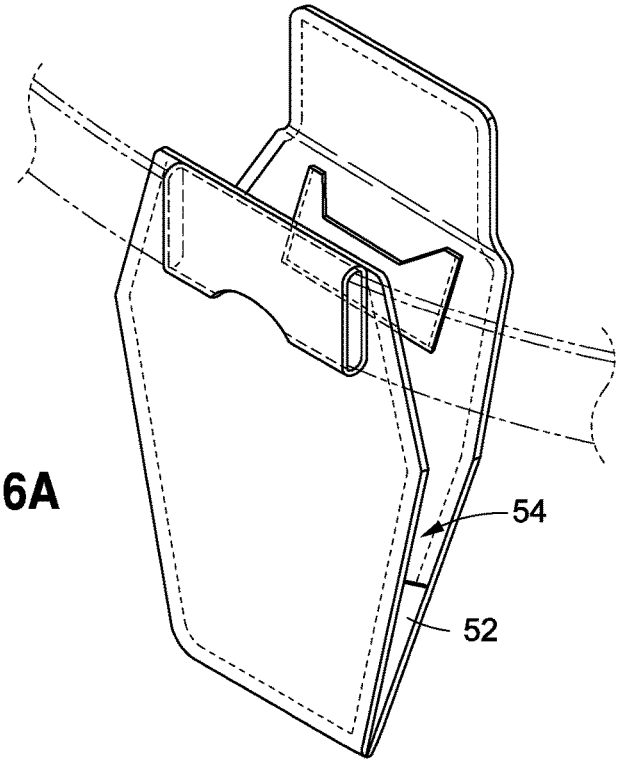
FIG. 6A is a perspective view of an inside waistband holster for a concealed weapon according to one exemplary embodiment.
Figure 6B:
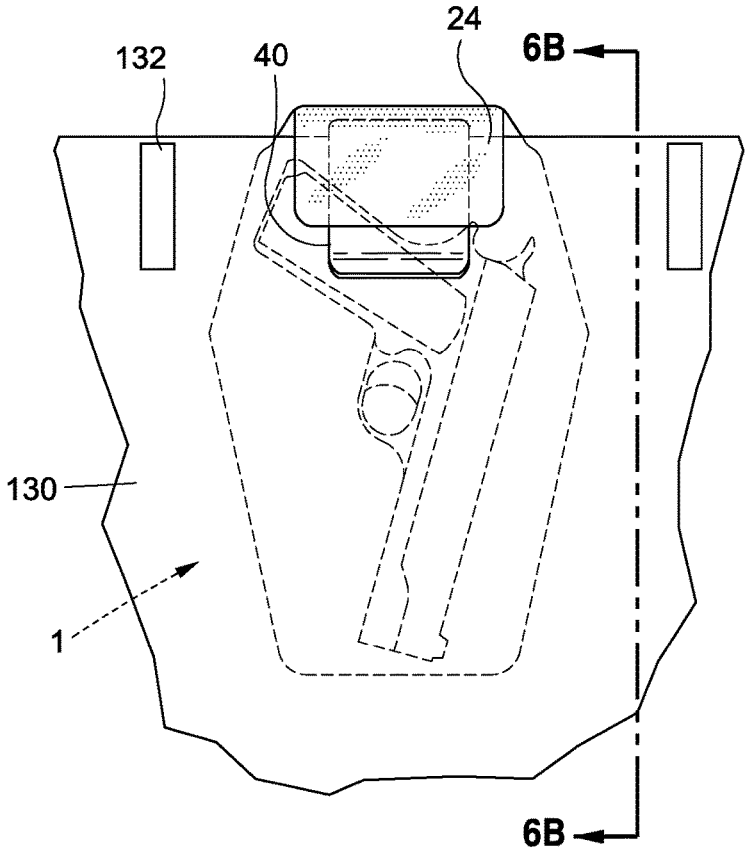
FIG. 6B is a front view of the holster shown in FIG. 6A.
Figure 6C:
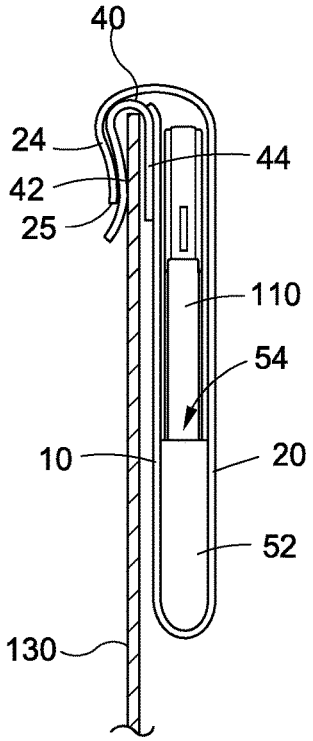
FIG. 6C is a side view of the holster shown in FIG. 6A.

FIG. 6A is a front perspective view of an inside waistband holster for a concealed weapon according to one exemplary embodiment; FIG. 6B is a front view of the holster shown mounted to the waistband with the holster located inside the wearer's pants, and FIG. 6C is a cross-sectional side view of the holster shown in FIG. 6B. In this embodiment, the holster 1 is configured so it may be worn by a user without a belt 120. Here, the holster 1 includes a clip 40 that attached to the top of the user's pants 130 without the need for the belt 120. Thus, as shown in FIG. 6A, there is no belt that is threaded through the belt loops 132 of the pants 130.

The clip 40 may be made of any suitable resilient material including plastics and metals that such that an outer side 42 and an inner side 44 of the clip may be biased together. The clip 40 may also include a torsion spring or other biasing member to bias the outer side 42 and inner side 44 together. In some embodiments, the clip 40 may be covered with a more visibly attractive material such as leather, faux leather, or other material, with the biased member being embedded therein. The clip 40 attached to the front panel 10 such that the holster 1 in this embodiment may operate similar to that described above.

In the embodiment illustrated in FIG. 6A, a pouch 54 is formed on a single panel. Here, the back panel 20 includes the pouch 54 by way of a pliable fabric member 52 stitched to the inner side of the back panel 20. The fabric member 52 may be formed of any suitable material as described above, and may be connected to the panel 20 in any suitable manner. One advantage to this embodiment is that the pouch 54 may extend to cover a substantial portion of the back panel 20 (e.g. may extend higher than shown in the FIGS. 6A-6C) while still allowing the front panel 10 to roll upwards in operation to access the firearm 110.

Other additions and/or modification may be made to offer additional conveniences to a user. As a first example, while a belt loop 14 and clip 40 have been described above, any other waistband connector to attach the front panel 10 to the waistband or other portion of the user's pants 130 may be utilized. As another example, an electronic key fob may be embedded in the belt loop, flap, or other portion of the holster 1 that is programmable to operate a remote device.

The holster 1 described above may not only be utilized to conceal a firearm, but the holster 1 may also be worn in a traditional style outside of the clothing where permitted. That is, the user may position the front and back panels 10, 20 of the holster 1 to be on the outside of the user's pants 130.

In other embodiments, the holster 1 may be sized to carry other items, and may thus be referred to as a carrier, pouch or the like. The above described holster 1 forms an "internal pocket" that is concealed underneath the wearer's clothing. Further, the holster 1 is securely attached to the belt loop or pants, and thus cannot be easily removed from the wearer. Thus, the pouch 34 may be sized to house and secure other items such as a wallet, travel documents such as passports and travel tickets, cell phones or other electronic devices, or the like. Accordingly, the holster 1 is not limited only to concealing and securing firearms. For example, if the holster 1 is particularly configured to hold a wallet or the like, the holster or carrier may be more rectangular in shape (e.g. have a generally flat bottom and straight sides) and may not be as deep (e.g. the distance from the top to the bottom of the pouch may be less) than if the carrier is particularly suited for a firearm.

Figure 7A:
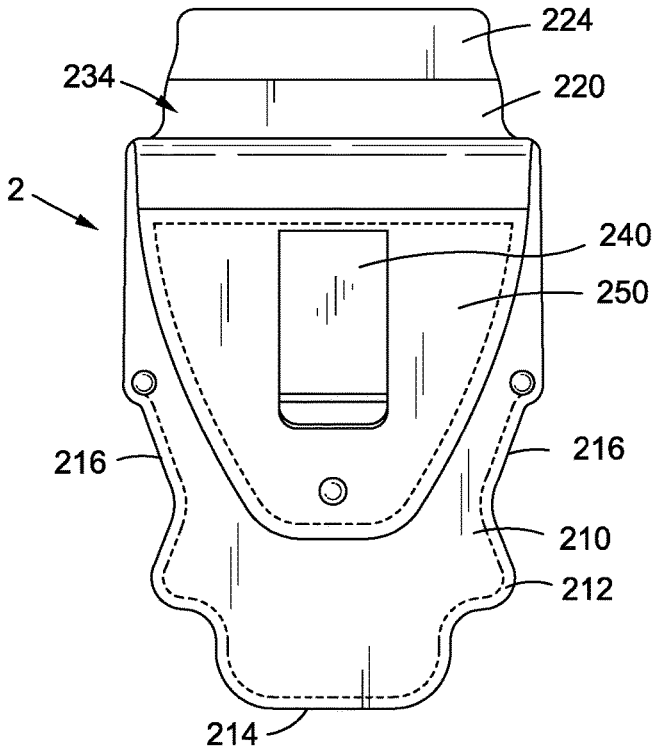
FIG. 7A is a front plan view of an inside waistband holster for a concealed weapon according to another embodiment.
Figure 7B:
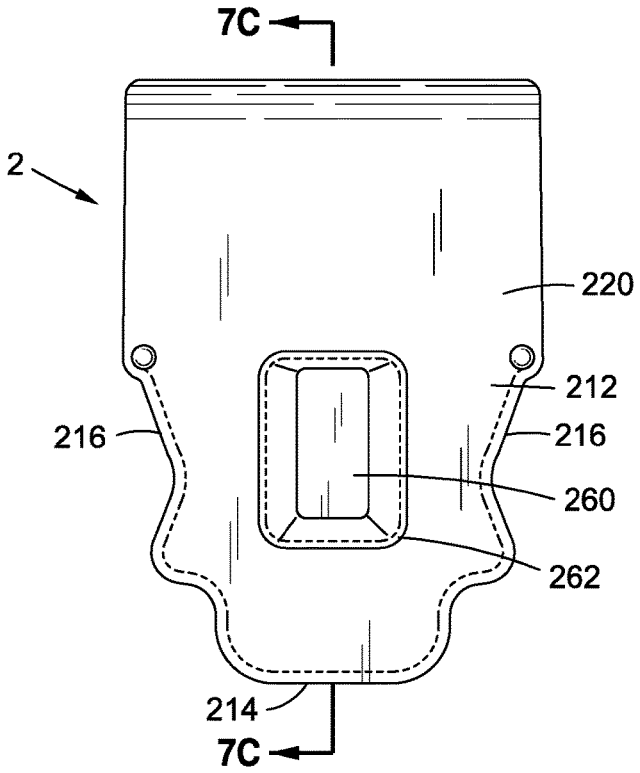
FIG. 7B is a rear plan view of the holster shown in FIG. 7A.
Figure 7C:
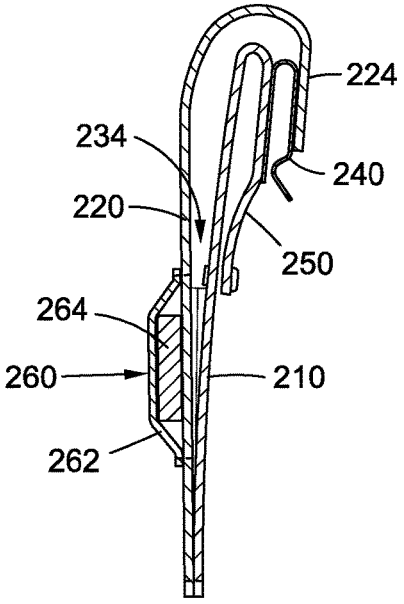
FIG. 7C is a side view of the holster shown in FIG. 7B.

Further enhancements and modifications may be made to the holster. FIGS. 7A-7C show another exemplary embodiment of an inside waistband holster. The holster 2 is formed from a front flap 210 and a rear flap 220 that are joined together at a bottom end 214 and partially up sides 216 by stitching 212. Other joining methods are also possible such as adhesives, fasteners, and the like. In some embodiments, the front and rear flaps 210, 220 may be formed integrally.

The front and rear flaps 210, 220 for a pouch 234. Similar to holster 1, the flaps 210, 220 are not joined on the upper portion of the holster 2 such that the flaps 210, 220 may separate when the holster 2 is pulled up from inside a waistband into an exposed position. The flaps 210, 220 and pouch 234 are sized according to the objects that are intended to be carried within the "internal pocket" or pouch 234. Such objects include firearms such as handguns; documents such as concealed carry permits, identification, passports, and other travel documents; wallets; electronic devices such as smartphones, MP3 players; and the like.

In this embodiment, the front flap 210 includes a folded-over tongue or extension 250. A belt clip 240 is mounted to the extension 250 and is used to attach the holster 2 to a belt or pants of the wearer. The extension 250 is formed from less pliable material than the flaps 210, 220 to hold its shape when the holster 2 is raised into the exposed position. The extension 250 is configured to sit inside the user's waistband of the user's pants, and ensures that the holster 2 slides out easily when being moved to the exposed position.

Specifically, the extension 250 provides a surface along which the front flap 210 slides when the holster 2 is removed from the waistband. The front flap 210 slides against the extension 250 and peels away as held by the belt clip 240 as the holster 2 is raised from inside the waistband. In this manner, any bulky items, such as a grip from a handgun or other item, do not catch on the waistband of the user. Thus, the holster 2 reliably slides up and peels out when the holster 2 is removed up into the exposed position.

The holster 2 further comprises a top flap 224 for that extends from the back flap 220. The top flap 224 is configured to cover the pouch 234 in the concealed position. The top flap 224 may comprise a magnet or other fastening device similar to top flap 24 of holster 1. In this manner, the top flap 224 attached to the belt clip 240 to close the pouch 234. In one example, the top flap 224 is magnetically closed by a magnet interacting with the belt clip 240 where the belt clip 240 is comprised of a magnetically attracted metallic material.

Other modifications may be made to the holster 2. For example, some models of firearms comprise laser sights which may be activated and de-activated by a switch, such as a switch which is triggered or actuated by a magnet. The holster 2 may include a mechanism for automatically activating and/or deactivating such sights when the firearm is placed within the holster 2. As shown in FIGS. 7B and 7C, the holster 2 may comprise a laser sight actuator 260. In this embodiment, the laser sight actuator 260 may comprise a sealed pocket 262 stitched onto the back flap 220 of the holster 2. A magnet 264 may be housed within the pocket 262 which interacts with the laser sight of the firearm when the firearm is holstered. In this manner, the laser sight may be automatically disabled when the firearm is holstered (and/or activated when the firearm is removed from the holster 2).

Other methods may also be used in place of the magnetically operated actuator 260 depending on the technology used in the laser sight of the firearm. For example, a RFID tag, NFC tag, or other device may be included with the laser actuator 260. Additionally, the laser actuator 260 may be disposed anywhere on the holster 260 in order to match with the location of the laser sight controller on a firearm.

In some embodiments, the insides of the flaps 210, 220 or the pouch 234 may include a surface that is configured to help secure the firearm within the holster 2. For example, the inside of the pouch (e.g. some or all of the interior surfaces of the flaps 210, 220) may include a rubber or silicone material (such as applied to the interior surfaces of the flaps 210, 220) to stabilize the firearm. For example, a high friction material, such as a layer of silicone or rubber, may be applied to the interior surfaces of the flaps 210, 220 at the bottom 214 (such as in the area where the flaps 210, 220 are stitched together) so as to grip or secure the muzzle portion of the firearm. This may help prevent the firearm from unintentionally becoming dislodged from the holster 2, especially as the holster is raised out of the waistband and into the exposed position and before the user grips the firearm to pull it from the holster.

The holster 2 illustrated in FIGS. 7A-7C also illustrates how the shape and/or size of the holster or carrier of the invention may vary.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A concealable, internal pocket comprising:

a pouch comprised of a front panel and a back panel, the front panel comprising a first side and a second side, the first side of the front panel facing an interior of the pouch, the front panel comprising a top portion that folds over and away from the pouch such that the first side of the front panel on the top portion faces away from the pouch, and the back panel comprising a cover portion that extends over a top opening of the pouch and over the front panel; and a waistline connector that is configured to attach to a waistline of a user's pants, the waistline connector being attached to the first side of the front panel on the top portion of the front panel, the cover portion of the back panel directly attaching to and detaching from the waistline connector.

2. The concealable, internal pocket of claim 1, wherein the front panel comprises a bottom and a pair of sides, and the back panel comprises a bottom and a pair of sides, the bottom of the back panel being connected to the bottom of the front panel and a portion of each side of the back panel extending upwardly from the bottom thereof being connected to a portion of each side of the front panel extending upwardly from the bottom thereof to define the pouch, a portion of the sides of the back panel not being connected to the front panel.

3. The concealable, internal pocket of claim 2, wherein when the cover portion of the back panel is not attached to the waistline connector, an object may be placed into the pouch between the front and back panels, wherein when the cover portion of the back panel is connected to the waistline connector, the object is secured in the pouch, and wherein when the cover portion of the back panel is pulled upwardly, the pouch is pulled upwardly as the front panel peels up from the top portion, and the object is positioned above the waistline of the user's pants for retrieval.

4. The concealable, internal pocket of claim 3, wherein the object is located completely below the top of the folded over front panel when the object is located in the pouch and the cover portion of the back panel is attached to the waistline connector.

5. The concealable, internal pocket claim 1, wherein the waistline connector comprises a belt loop attached to the top portion of the front panel.

6. The concealable, internal pocket claim 1, wherein the waistline connector comprises a clip attached to the top portion of the front panel.

7. The concealable, internal pocket of claim 6, wherein the cover portion of the back panel comprises a magnet that removably attaches to the clip.

8. The concealable, internal pocket of claim 1, wherein the top portion of the front panel is attached to an inside portion of the waistline connector, the front panel including the top portion and the inside portion of the waistline connector being configured to be disposed on an inside of the user's pants while the waistline connector is attached to the waistline of the user's pants.

9. The concealable, internal pocket of claim 1, wherein the pouch is sized to fit at least one of a firearm, wallet, cellphone, and passport.

10. The concealable, internal pocket of claim 1, wherein the pouch defines a holster for a firearm, the concealable, internal pocket further comprising a laser sight deactivator configured to deactivate a laser sight of the firearm.

11. The concealable, internal pocket of claim 10, wherein the laser sight deactivator comprises at least one of a magnet, a RFID tag, and an NFC tag.

12. A concealable, internal pocket comprising:

a waistband connector configured to attach at a waistline of a user's pants;

a front panel formed from a pliable material, the front panel comprising a folded over tongue extension extending from the top of the front panel, the tongue extension being attached to the waistband connector; and a back panel formed from the pliable material, the back panel attached to the front panel along a bottom side of the back panel and the front panel and along lower sides of the back panel and the front panel, the front panel and the back panel defining a pouch in which an object may in stored, a top portion of the front panel being unattached to a top portion of the back panel, the back panel further comprising a flap extending from the top portion of the back panel and being configured to extend over the front panel and to directly and releasably connect to the waistband connector.

13. The concealable, internal pocket of claim 12 wherein the flap is configured to be pulled upward such that the top portion of the front panel peels away from the top portion of the back panel and up from the tongue extension into an exposed position.

14. The concealable, internal pocket of claim 12, wherein the flap comprises an embedded magnet and the waistband connector comprises a corresponding embedded magnet or magnetically attractive material, and the embedded magnet and the corresponding embedded magnet or magnetically attractive material are configured to releasably connect.

15. The concealable, internal pocket of claim 12, wherein the waistband connector is a clip, the clip being configured to attach to the waistline of the user's pants.

16. The concealable, internal pocket of claim 12, further comprising at least one slot configured to receive one or more of an identification card, a concealed weapons license, and a credit card.

17. The concealable, internal pocket of claim 12, wherein the pouch is configured to simultaneously hold a firearm and one or more of keys, a wallet, and a phone.

18. The concealable, internal pocket of claim 12, wherein the pouch defines a holster for a firearm, the concealable, internal pocket further comprising a laser sight deactivator configured to deactivate a laser sight of the firearm.

19. The concealable, internal pocket of claim 18, wherein the laser sight deactivator comprises at least one of a magnet, a RFID tag, and an NFC tag.

20. The concealable, internal pocket of claim 12, wherein a surface of an interior of the pouch comprises a rubber or a silicone material.

* * * * *